US008919926B2

(12) United States Patent
Mizukami et al.

(10) Patent No.: US 8,919,926 B2
(45) Date of Patent: Dec. 30, 2014

(54) INKJET HEAD AND INKJET PLOTTER

(75) Inventors: Satoshi Mizukami, Kanagawa (JP); Masaki Kato, Tokyo (JP); Takahiko Kuroda, Hyogo (JP); Yoshikazu Akiyama, Kanagawa (JP); Kanshi Abe, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 33 days.

(21) Appl. No.: 13/408,073

(22) Filed: Feb. 29, 2012

(65) Prior Publication Data

US 2012/0229573 A1 Sep. 13, 2012

(30) Foreign Application Priority Data

Mar. 7, 2011 (JP) ..... 2011-049677

(51) Int. Cl.
*B41J 2/16* (2006.01)
*B41J 2/14* (2006.01)

(52) U.S. Cl.
CPC ..... *B41J 2/161* (2013.01); *B41J 2002/14491* (2013.01); *B41J 2/14233* (2013.01); *B41J 2/1631* (2013.01); *B41J 2/1646* (2013.01); *B41J 2/1629* (2013.01); *B41J 2/1628* (2013.01)
USPC ..... 347/50

(58) Field of Classification Search
CPC ..... B41J 2/14233; B41J 2/14209; B41J 2002/14491
USPC ..... 347/68, 71, 72, 50
See application file for complete search history.

(56) References Cited

U.S. PATENT DOCUMENTS

| | | | | |
|---|---|---|---|---|
| 6,806,108 | B2 * | 10/2004 | Park et al. | 438/21 |
| 7,416,286 | B2 * | 8/2008 | Murata | 347/58 |
| 7,559,631 | B2 | 7/2009 | Shimada et al. | |
| 7,963,640 | B2 * | 6/2011 | Tokunaga et al. | 347/71 |
| 7,980,679 | B2 * | 7/2011 | Seto et al. | 347/68 |
| 8,083,328 | B2 * | 12/2011 | Kitahara et al. | 347/71 |
| 8,251,490 | B2 * | 8/2012 | Ciampini et al. | 347/45 |
| 8,313,177 | B2 * | 11/2012 | Hirai et al. | 347/71 |

(Continued)

FOREIGN PATENT DOCUMENTS

| | | |
|---|---|---|
| JP | 2004-330567 | 11/2004 |
| JP | 2006-44225 | 2/2006 |

(Continued)

OTHER PUBLICATIONS

Japanese official action dated Oct. 7, 2014 in corresponding Japanese patent application No. 2011-049677.

*Primary Examiner* — Matthew Luu
*Assistant Examiner* — Patrick King
(74) *Attorney, Agent, or Firm* — Cooper & Dunham LLP

(57) ABSTRACT

A disclosed inkjet head includes a liquid chamber formed by a space between a vibrating plate and a nozzle substrate and separated by partitions; a piezoelectric element formed by sequentially laminating a common electrode, a piezoelectric substance and an individual electrode over the space; first to fourth insulating films respectively having first to fourth openings; and a first wiring connected to the individual electrode and pulled through the first and second openings over the common electrode, wherein the first wiring passes through the third opening over the third insulating film, the first wiring is exposed from the fourth opening so as to be externally connected, and the third insulating film and the fourth insulating film are not partly formed above the liquid chamber and formed above the first wiring.

16 Claims, 4 Drawing Sheets

(56) References Cited

U.S. PATENT DOCUMENTS

| | | | | |
|---|---|---|---|---|
| 2003/0136002 | A1* | 7/2003 | Nishikawa et al. | 29/890.1 |
| 2003/0210300 | A1* | 11/2003 | Silverbrook | 347/54 |
| 2006/0066676 | A1* | 3/2006 | Sanada | 347/50 |
| 2006/0066688 | A1* | 3/2006 | Sugimoto et al. | 347/68 |
| 2006/0209139 | A1* | 9/2006 | Murata | 347/71 |
| 2008/0043067 | A1* | 2/2008 | Nayve et al. | 29/890.1 |
| 2008/0062229 | A1* | 3/2008 | Tokunaga et al. | 347/72 |
| 2009/0153625 | A1* | 6/2009 | Kobayashi et al. | 347/68 |
| 2010/0182375 | A1* | 7/2010 | Ciampini et al. | 347/47 |
| 2011/0090289 | A1 | 4/2011 | Mizukami | |

FOREIGN PATENT DOCUMENTS

| | | |
|---|---|---|
| JP | 2006-213028 | 8/2006 |
| JP | 2007-135297 | 5/2007 |
| JP | 2009-18449 | 1/2009 |
| JP | 4371209 | 9/2009 |
| JP | 2010-42683 | 2/2010 |

* cited by examiner

INKJET HEAD AND INKJET PLOTTER

BACKGROUND OF THE INVENTION

1. Field of the Invention

The present invention generally relates to an inkjet head and an inkjet plotter.

2. Description of the Related Art

There is an exemplary technique applied with MicroElectroMechanical System (MEMS) for densely packing an inkjet head using a piezoelectric element.

The inkjet head is obtained by patterning an individual electrode, an common electrode and a piezoelectric substance on a vibrating plate to thereby form a piezoelectric element as an actuator.

However, a piezoelectric substance may be degraded by moisture in the air.

Patent Document 1 discloses a flow path forming substrate on which a pressure generating chamber communicating with nozzle openings for discharging droplets, a piezoelectric element made of a lower electrode provided on one side surface of the flow path forming substrate via a vibrating plate, a piezoelectric substance layer and an upper electrode, and an upper electrode lead electrode drawn out of the upper electrode. At this time, pattern areas in the layers forming the piezoelectric element and the upper electrode lead electrode except for areas facing connection wirings of the lower electrode and the upper electrode lead electrode are coated by an insulating film made of an inorganic amorphous material. The insulating film includes a first insulating film and a second insulating film, and the piezoelectric element except for a connecting portion connected with the upper electrode lead electrode is covered by the first insulating film. The upper electrode lead electrode extends on the first insulating film. The pattern areas of the layers forming the piezoelectric element and the upper electrode lead electrode except for the area facing the connecting portion of the connection wirings is coated by the second insulating layer.

However, because the upper electrode lead electrode is not formed on the lower electrode, there is a problem that the inkjet head cannot be downsized.

Patent Document 1: Japanese Laid-Open Patent Application No. 2010-42683

SUMMARY OF THE INVENTION

Accordingly, embodiments of the present invention provide a novel and useful inkjet head and an inkjet plotter solving one or more of the problems discussed above. More specifically, the embodiments of the present invention may provide an inkjet head and an inkjet plotter including the inkjet head with which the piezoelectric substance can be prevented from degrading with the moisture in the air and being highly densely packed and simultaneously downsized.

One aspect of the embodiments of the present invention may be to provide an inkjet head including a nozzle substrate having a nozzle; a vibrating plate formed above the nozzle substrate; a liquid chamber formed by a space between the vibrating plate and the nozzle substrate and separated by partitions; a piezoelectric element formed by sequentially laminating a common electrode, a piezoelectric substance and an individual electrode over the space, the common electrode extending above the partition; a first insulating film having a first opening; a second insulating film formed on the first insulating film and having a second opening; a third insulating film formed on the second insulating film and having a third opening; a fourth insulating film formed on the third insulating film and having a fourth opening; and a first wiring connected to the individual electrode and pulled through the first opening and the second opening over the common electrode, wherein the first wiring passes through the third opening over the third insulating film, wherein the first wiring is exposed from the fourth opening so as to be externally connected, wherein the third insulating film and the fourth insulating film are not partly formed above the liquid chamber and formed above the first wiring.

Additional objects and advantages of the embodiments will be set forth in part in the description which follows, and in part will be clear from the description, or may be learned by practice of the invention. Objects and advantages of the invention will be realized and attained by means of the elements and combinations particularly pointed out in the appended claims.

It is to be understood that both the foregoing general description and the following detailed description are exemplary and explanatory only and are not restrictive of the invention as claimed.

DETAILED DESCRIPTION OF THE PREFERRED EMBODIMENTS

A description is given below, with reference to the FIG. 1A through FIG. 2B of embodiments of the present invention.

Reference symbols typically designate as follows:

100: inkjet head;
110: liquid chamber;
111: nozzle substrate;
111*a*: nozzle;
112: liquid chamber substrate;
112*a*: vibrating plate;
112*b*: partition;
120: piezoelectric element;
121: common electrode;
122: piezoelectric substance;
123: individual electrode;
131, 132, 133, 134: insulating layer;
131*a*, 132*a*, 133*a*: opening;
131*b*, 132*b*, 133*b*: opening;
134*a*, 134*b*: contact hole; and
140, 150: wiring.

Figure 1A:
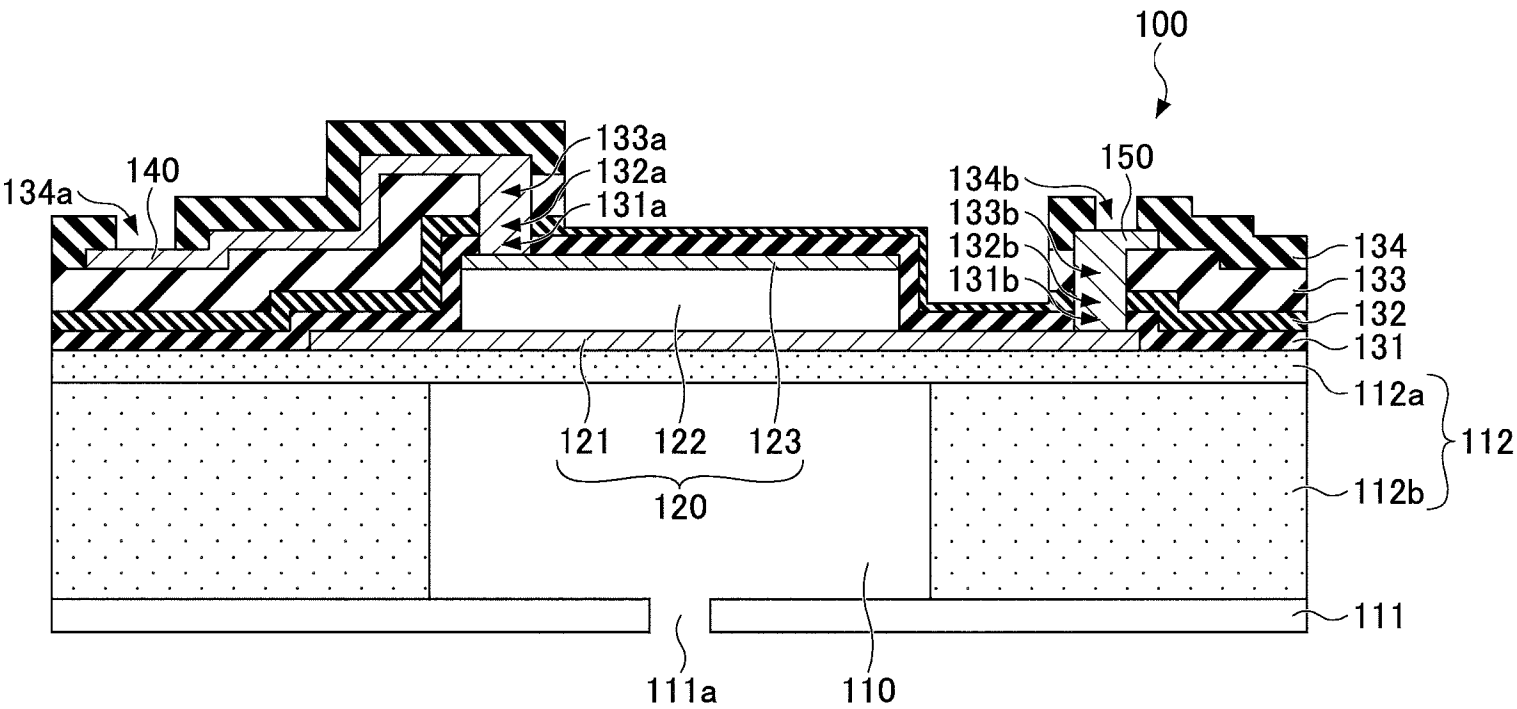
FIG. 1A is an exemplary cross-sectional view of a part of an inkjet head of an embodiment of the present invention.
Figure 1B:
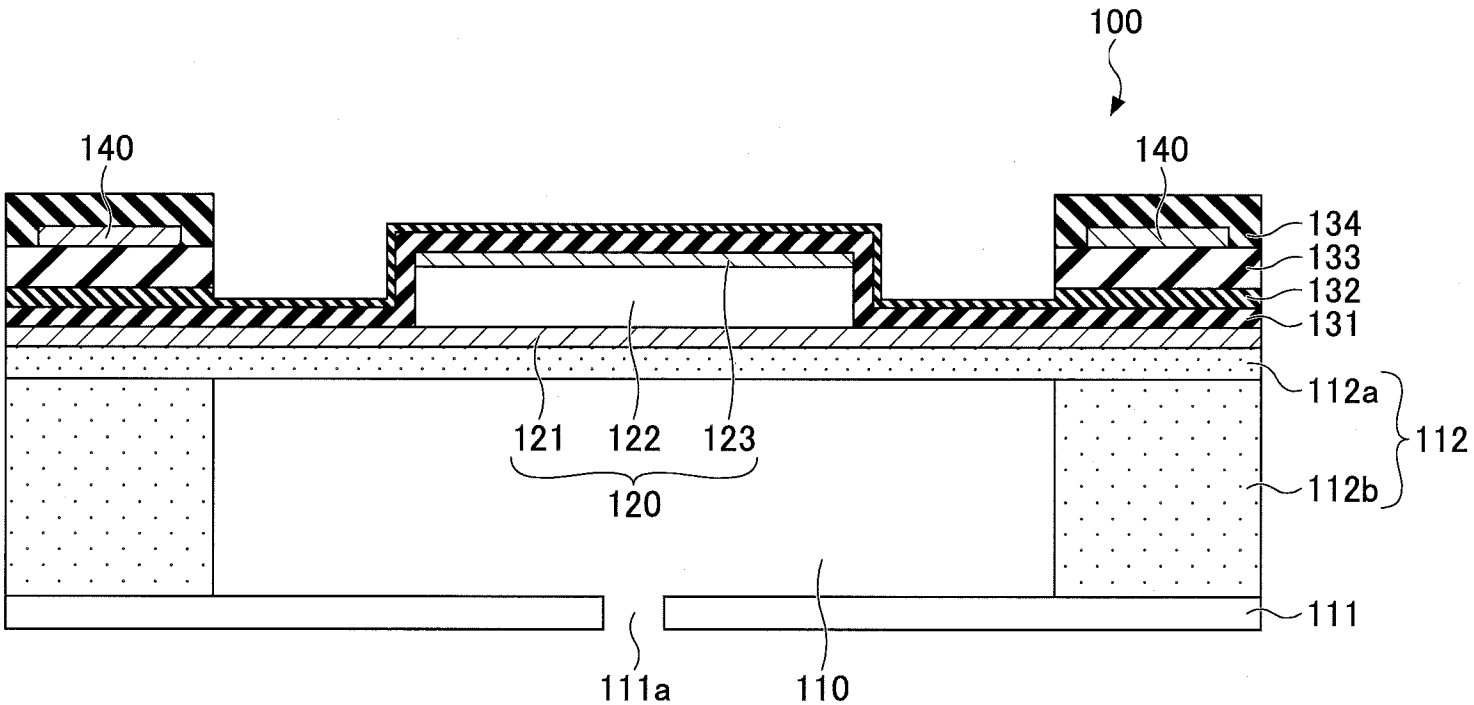
FIG. 1B is an exemplary cross-sectional view of a part of the inkjet head of the embodiment of the present invention.

FIG. 1A and FIG. 1B are exemplary cross-sectional views of a part of the inkjet head of the embodiment of the present invention. FIG. 1B is a cross-sectional view of the part taken along a direction perpendicular to a direction of taking along the part in FIG. 1A.

Plural liquid chambers 110 are formed in the inkjet head 100. The plural liquid chambers 110 are formed by bonding a nozzle substrate 111 having plural nozzles 111*a*, a vibrating plate 112*a* arranged on the nozzle substrate 111, and a liquid chamber substrate 112 having a partition 112*b* using a bond. Said differently, the plural liquid chambers 110 are formed by separating a space between the nozzle substrate 111 and the vibrating plate 112*a* by the partitions 112*b*.

Referring to FIG. 1A and FIG. 1B, only one liquid chamber 110 is illustrated. However, the inkjet head 100 may have plural liquid chambers 110 arranged in a lateral direction of FIG. 1B.

Further, a common electrode 121 is formed on the vibrating plate 112*a*. A piezoelectric substance 122 and an individual electrode 123 are sequentially formed on the common electrode 121 corresponding to the space separated by the partition 112*b*. Said differently, the piezoelectric elements 120 are formed on the spaces separated by the partitions 112*b* of the vibrating plates 112*a*.

Insulating films 131 and insulating films 132 are sequentially formed on the vibrating plates 112*a* formed on the piezoelectric elements 120, respectively. The insulating films 131 have openings 131*a* at positions corresponding to the individual electrodes 123, respectively. The insulating films 132 have openings 132*a* at positions corresponding to the individual electrodes 123, respectively.

Wirings 140 are drawn onto regions including a part of the common electrode 121 via the openings 131*a* and 132*a* from the individual electrodes, respectively. Insulating films 133 having openings 133*a* through which the wirings 140 are drawn are formed between the insulating film 132 and the region including the wiring 140. The openings 131*a*, 132*a* and 133*a* form a contact hole. Insulating films 134 having contact holes 134*a* through which wirings (not illustrated) for electrically connecting the wirings 140 and driving circuits (not illustrated) are formed on the wirings 140. The insulating films 133 and the insulating films 134 are not formed over regions of the spaces separated by the partitions 112*b* except for the regions including the wirings 140.

Meanwhile, the insulating films 131 and 132 have openings 131*b* and 132*b*, respectively. Wirings 150 are drawn onto regions including parts of the common electrodes 121 from the common electrodes 121 via the openings 131*b* and 132*b*. Insulating films 133 having openings 133*a* through which the wirings 150 are drawn are formed between the insulating film 133 and the region including the wiring 150. The openings 131*a*, 132*a* and 133*a* form a contact hole. Further, insulating films 134 having contact holes 134*b* through which wirings (not illustrated) for electrically connecting the wirings 150 and driving circuits (not illustrated) are formed on the wirings 150.

The insulating films 131 coat the vibrating plates 112*a* on which the piezoelectric elements 120 are formed except for the openings 131*a* and the openings 131*b*. The insulating films 131 prevent the piezoelectric elements 120 from being etched.

The material of the insulating film 131 is not specifically limited. The material may be oxides such as $Al_2O_3$, $ZrO_2$, $Y_2O_3$, $Ta_2O_3$ and $TiO_2$, nitrides, carbides or the like or may be two or more of the oxides, the nitrides, the carbides or the like in order to prevent degradation of the piezoelectric elements 120 and displacement of the vibrating plates 112*a*.

The film thicknesses of the insulating films 131 are preferably 20 to 100 nm. If the film thicknesses of the insulating films 131 are less than 20 nm, the piezoelectric element 120 may deteriorate. If the film thicknesses of the insulating films 131 are more than 100 nm, the displacement of the vibrating plates 112*a* may be impaired.

A method of forming the insulating film 131 is not specifically limited. In order to prevent the degradation of the piezoelectric elements 120, a vapor-deposition technique and an atomic layer deposition (ALD) technique are preferable, more preferably the ALD technique.

The insulating films 132 coats the vibrating plate 112*a* on which the piezoelectric element 120 is formed except for the opening 132*a* and the opening 132*b* in a manner similar to the insulating film 131. At this time, the insulating film 132 is a mask layer used to etch the insulating film 133 to be described later. The film thickness of the region in which the insulating film 133 is formed is greater than a region in which the insulating film 133 is not formed by over-etching. With this, it is possible to prevent the displacement of the piezoelectric element from being impaired to thereby obtain an excellent discharge property of the inkjet head 100.

The material of the insulating film 132 is not specifically limited, and may be oxides such as $Al_2O_3$, $ZrO_2$, $Y_2O_3$, $Ta_2O_3$ and $TiO_2$, or may be two or more of the oxides.

The film thickness of the insulating film 132 at a position laminated below the insulating film 133 is ordinarily 20 to 100 nm. If the film thickness of the insulating film 132 at the position laminated below the insulating film 133 is less than 20 nm, the insulating film 131 in the region where the insulating film 133 is not formed may be etched. If the film thickness of the insulating film 132 at the position laminated below the insulating film 133 is more than 100 nm, the displacement of the vibrating plate 112*a* may be impaired.

The film thickness of the insulating film 132 at a position not being laminated below the insulating film 133 is ordinarily 5 to 40 nm. If the film thickness of the insulating film 132 at the position not being laminated below the insulating film 133 is less than 5 nm, the insulating film 131 in the region where the insulating film 133 is not formed may be etched. If the film thickness of the insulating film 132 at the position not being laminated below the insulating film 133 is more than 40 nm, the displacement of the vibrating plate 112*a* may be impaired.

A method of forming the insulating film 132 is not specifically limited. In order to prevent the degradation of the piezoelectric elements 120, a vapor-deposition technique and an atomic layer deposition (ALD) technique are preferable, more preferably the ALD technique.

The insulating film 133 is formed together with the insulating films 131 and 132 between the wiring 140 and the common electrode 121. The insulating film is an inter-layer protection film for preventing insulation breakdown between the wiring 140 and the common electrode 121. With this, a degree of freedom in arranging the individual electrode 123 and the wiring 140 becomes high. Even if the inkjet head 100 is highly densely packed, it can be downsized. Because the etched insulating film 133 is not formed over the space separated by the partition 112*b* except for the region including the wiring 140, it is possible to prevent from impairing the displacement of the piezoelectric element 120. Therefore, the inkjet head 100 is excellent in the discharge property.

The material of the insulating film 133 is not specifically limited. However, the material may be an inorganic material, i.e., oxides such as $SiO_2$, nitrides, carbides or the like or may be two or more of the oxides, the nitrides, the carbides or the like in order to obtain contact with the wiring 140.

The film thickness of the insulating film 133 is ordinarily 200 nm or more, more preferably 500 nm or greater. If the film thickness of the insulating film 133 is 200 nm or less, a voltage applied between the common electrode 121 and the wiring 140 may cause insulation breakdown.

The method of forming the insulating film 133 is not specifically limited, and may be a plasma CVD method, a sputtering method or the like. Because the insulating film can be isotropically formed, a plasma CVD method is preferable.

The method of etching the insulating film 133 is not specifically limited, and may be a method using photolithography and dry etching.

The method of forming the contact hole including the openings 131*a*, 132*a* and 133*a* and the contact hole including the openings 131*b*, 132*b* and 133*b* are not specifically limited, and may be a method using photolithography and dry etching.

The insulating film 134 is a passivation layer which coats the wirings 140 and 150 except for the contact holes 134*a* and the contact holes 134*b* and protect the wirings 140 and 150. Because the etched insulating film 134 is not formed over the space separated by the partition 112*b* except for the region including the wiring 140, it is possible to prevent from impairing the displacement of the piezoelectric element 120. Therefore, the inkjet head 100 is excellent in the discharge property.

The material of the insulating film 134 is not specifically limited and may be an inorganic material, i.e., oxides, nitrides, carbides or the like, an organic material such as a polyimide, an acrylic resin and an urethane resin, or may be two or more of the inorganic materials and the organic material. Among these materials, the inorganic material is preferable because the material can be patterned by etching.

The film thickness of the insulating film 134 is ordinarily 200 nm or more, more preferably 500 nm or greater. If the film thickness of the insulating film 134 is 200 nm or smaller, the wirings 140 and 150 may be eroded to cause disconnection.

The method of forming the insulating film 134 is not specifically limited, and may be a plasma CVD method, a sputtering method or the like. Because the insulating film can be isotropically formed, a plasma CVD method is preferable.

The method of etching the insulating film 134 is not specifically limited, and may be methods using photolithography and dry etching.

The material of forming the nozzle substrate 111 is not specifically limited and may be stainless steel and polyimide.

The liquid chamber substrate 112 can be formed by anisotropically etching a silicon monocrystalline substrate having a plane direction of (100) on which the vibrating plate 112*a* is formed by laminating Si, $SIO_2$, $Si_3N_4$ with the plasma CVD method.

The film thickness of the liquid chamber substrate 112 is ordinarily 100 to 600 nm.

If the piezoelectric substance 122 is a Lead Zirconate Titanate (PZT) having linear expansion coefficient of $8\times10^{-6}$ [1/K], linear expansion coefficients of the material of the vibrating plate 112*a* is preferably $5\times10^{-6}$ to $1\times10^{-5}$ to, more preferably $5\times10^{-6}$ to $1\times10^{-5}$.

The material forming the vibrating plate 112*a* may be an aluminum oxide, a zirconium oxide, an iridium oxide, a ruthenium oxide, a tantalum oxide, a hafnium oxide, an osmium oxide, a rhenium oxide, a rhodium oxide, or a palladium oxide, or two or more of these.

The method of forming the vibrating plate 112*a* is not specifically limited and may be a sputtering method, a sol-gel method or the like.

The thickness of the vibrating plate 112*a* is ordinarily 0.1 to 10 μm, preferably 0.5 to 3 μm. If the thickness of the vibrating plate 112*a* is less than 0.1 μm, a manufacturing process may be difficult. If the thickness of the vibrating plate 112*a* is greater than 10 μm, the displacement of the vibrating plate 112*a* becomes difficult.

The material of the common electrode 121 is not specifically limited and may be a conductive metal oxide.

The conductive metal oxide may preferably be a combined metal oxide containing a major ingredient of a chemical compound expressed by the following formula: $ABO_3$, where A represents Sr, Ba, Ca of La and B represents Ru, Co or Ni.

Exemplary combined metal oxides are $SrRuO_3$, $CaRuO_3$, $(Sr_{1-x}Ca_x)RuO_3$, $LaNiO_3$, $SrCoO_3$, or $(La_{1-y}Sr_y)(Ni_{1-y}Co_y)O_3$.

A conductive metal oxide other than a combined metal oxide is $IrO_2$ or $RuO_2$.

The common electrode 121 is a laminated body of a metal and a conductive metal oxide.

The metal is not specifically limited and may be a platinum group element such as Ru, Rh, Pd, Os, Ir and Pt and an alloy of the platinum group elements.

It is preferable to form a laminated body of a metal and a conductive metal oxide on Ti, $TiO_2$, TiN, Ta, $Ta_2O_5$, $Ta_3N_5$ or the like in order to improve contact with the vibrating plate 112*a*.

The method of forming the common electrode is not specifically limited and may be a sputtering method, a sol-gel method or the like.

The material of the piezoelectric substance 122 is not specifically limited and may be a combined metal oxide such as PZT. PZT is a solid solution of lead zirconate ($PbZrO_3$) and lead titanate ($PbTiO_3$). One of PZT generally showing an excellent piezoelectric property is $Pb(Zr_{0.53}Ti_{0.47})O_3$.

The combined metal oxide other than PZT is barium titanate or the like.

The major ingredient of the combined metal oxide can be expressed by the following formula: $ABO_3$, where A represents Pb, Ba or Sr and B represents Ti, Zr, Sn, Ni, Zn, Mg or Nb.

Exemplary combined metal oxides are $(Pb_{1-x}Ba_x)(Zr,Ti)O_3$, $(Pb_{1-x}Sr_x)(Zr,Ti)O_3$. These exemplary combined metal oxides are obtained by replacing a part of Pb of PZT with Ba or Sr. Pb of PZT can be replaced by a dyad to enable relaxing degradation of the property caused by evaporation of lead during heat treatment.

The method of forming the piezoelectric substance 122 is not specifically limited and may be a sputtering method, a sol-gel method or the like.

The method of patterning the piezoelectric substance 122 is not specifically limited and may be photolithography and etching processes.

The material of the individual electrode 123 is not specifically limited and may be a conductive metal oxide.

The conductive metal oxide may preferably be a combined metal oxide containing a major ingredient of a chemical compound expressed by the following formula: $ABO_3$, where A represents Sr, Ba, Ca of La and B represents Ru, Co or Ni.

Exemplary combined metal oxides are $SrRuO_3$, $CaRuO_3$, $(Sr_{1-x}Ca_x)RuO_3$, $LaNiO_3$, $SrCoO_3$, or $(La_{1-y}Sr_y)(Ni_{1-y}Co_y)O_3$.

A conductive metal oxide other than a combined metal oxide is $IrO_2$ or $RuO_2$.

The individual electrode 123 may be a laminated body of a conductive metal oxide and a metal.

The metal is not specifically limited and may be a platinum group element such as platinum and iridium, an Ag alloy, Cu, Al, Au or the like.

The method of forming the individual electrode 123 is not specifically limited and may be a sputtering method, a sol-gel method or the like.

The method of patterning the individual electrode 123 is not specifically limited and may be photolithography and etching processes.

The material of the wirings 140 and 150 is not specifically limited and may be an Ag alloy, Cu, Al, Au, Pt, Ir or the like.

The method of forming the vibrating plate 112*a* is not specifically limited and may be a sputtering method, a sol-gel method or the like.

The method of patterning the wirings 140 and 150 is not specifically limited and may be photolithography and etching processes.

The wirings 140 and 150 are formed by partly reforming surfaces of the insulating film 133 and patterning on the reformed part of the insulating film using an inkjet method. For example, if the material forming the insulating film 133 is an oxide, the surface of the insulating film 133 may be reformed by a silicon analog. As a result, it is possible to directly depict a highly-dense pattern using an inkjet method on a region where surface energy is increased.

The wirings 140 and 150 can be patterned by conductive paste using screen printing.

For example, commercialized products of the conductive paste are Perfect Gold ("Perfect Gold" is a registered trademark) being gold paste manufactured by Ulvac Coating Corporation, Perfect Copper being copper paste manufactured by Ulvac Coating Corporation, OrgaconPaste variant 1/4 and Paste variant 1/3 being Transparent Printing Ink PEDOT/PSS manufactured by Agfa-Gevaert Japan, Ltd, OrgaconCarbon Paste variant 2/2 being carbon electrode paste manufactured by Agfa-Gevaert Japan, Ltd, BAYTRON (BAYTRON (Upper case) is a registered trademark) being PEDT/PSS aqueous solution manufactured by Starck-V TECH Japan, Ltd.

The thickness of the wirings 140 and 150 is ordinarily 0.1 to 20 μm, preferably 0.2 to 10 μm. If the thickness of the wirings 140 and 150 is smaller than 0.1 μm, the resistances of the wirings 140 and 150 may increase. If the thickness of the wirings 140 and 150 is greater than 20 μm, the process time may be extended.

Figure 2A:
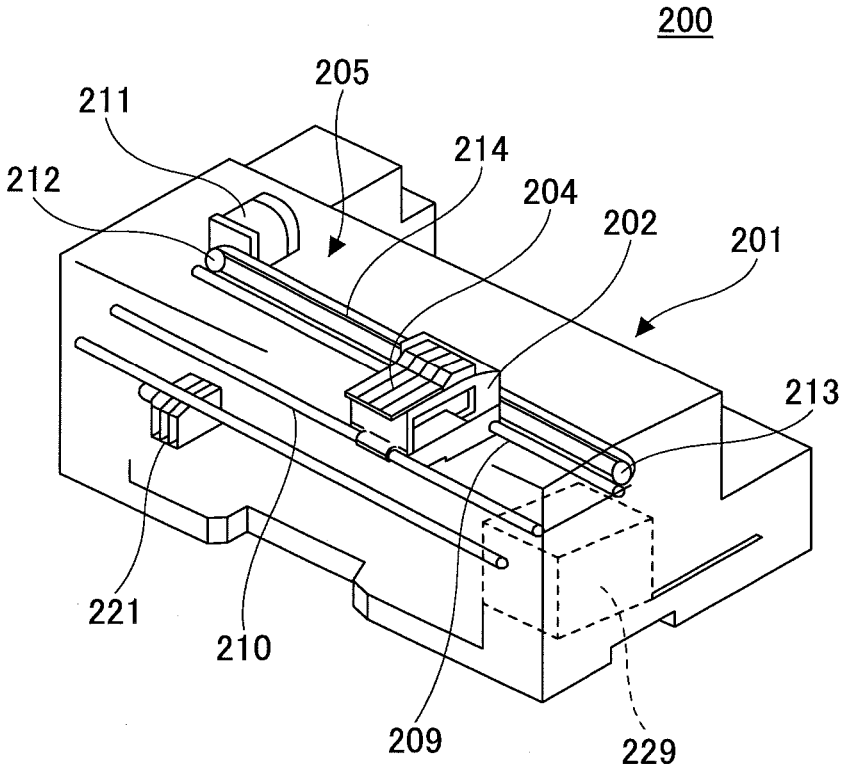
FIG. 2A illustrates an exemplary inkjet plotter of the embodiment of the present invention.
Figure 2B:
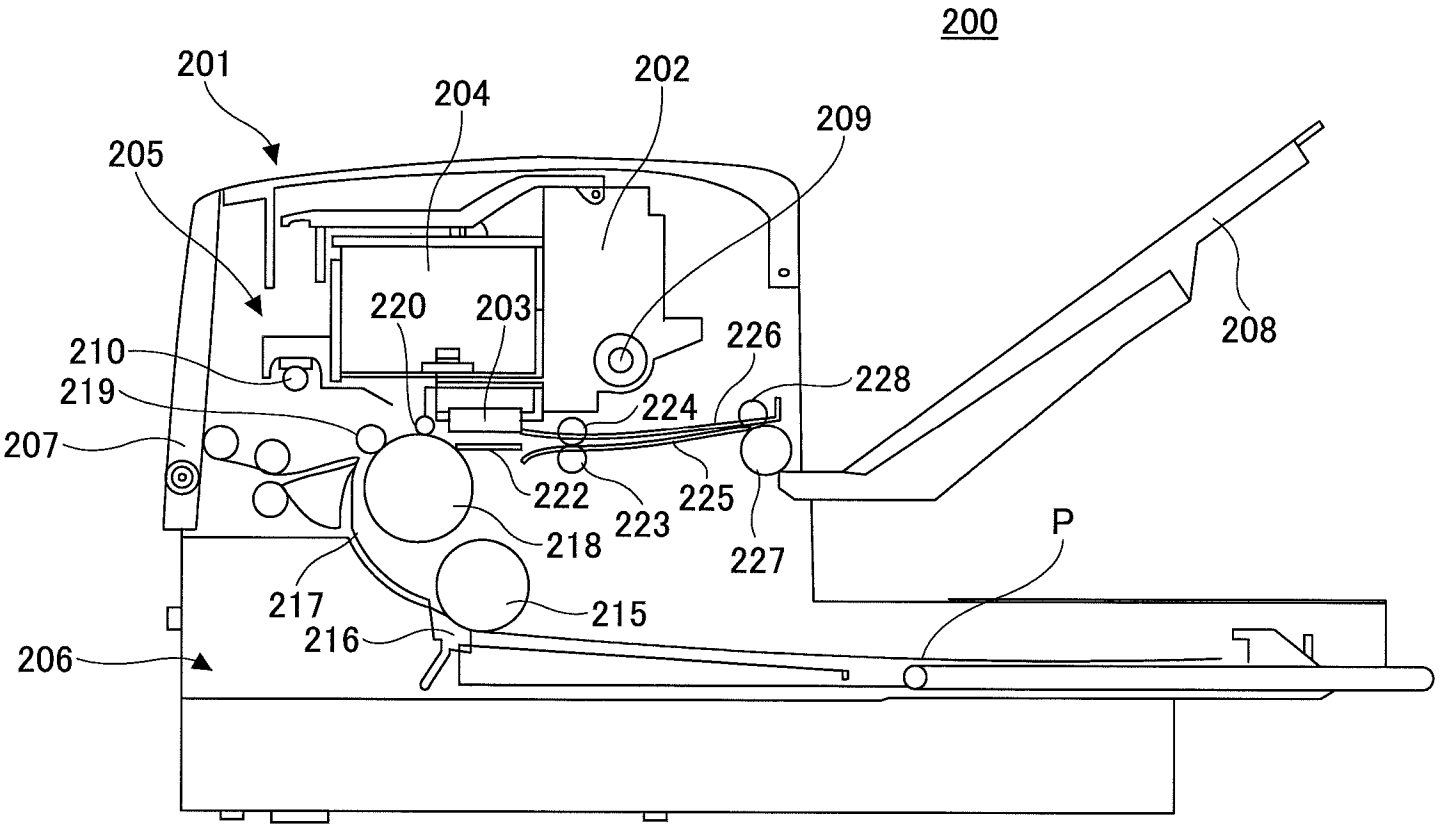
FIG. 2B illustrates an exemplary inkjet plotter of the embodiment of the present invention.

FIG. 2A and FIG. 2B are an exemplary inkjet plotter of the inkjet head of the embodiment of the present invention. FIG. 2A is a perspective view of the exemplary inkjet plotter, and FIG. 2B is a side view of a mechanical portion.

An inkjet plotter 200 includes inside a main body 201 a carriage 202, an inkjet head 203 installed in the carriage 202, and a print mechanism unit 205 including an ink cartridge 204. A lower portion of the inkjet plotter 200 can be freely loaded with or unloaded from a paper feed cassette 206 which can receive paper P from a front side of the paper feed cassette and stack the paper P. Further, the lower portion of the inkjet plotter 200 has a manual paper feed tray 207 which is opened for manually feeding paper P. The inkjet plotter 200 takes the paper P fed from the paper feed cassette 206 or the manual paper feed tray 207 in, copies (records) an image onto a paper by the print mechanism unit 205, and ejects the copied paper to a copy receiving tray 208.

The carriage 202 is held by a main guide rod 209 laterally supported by right and left side plates (not illustrated) and a sub guide rod 210 so that the carriage 202 freely slides in a main scanning direction. The inkjet head 203 for discharging various colored ink of yellow (Y), cyan (C), magenta (M) and black (Bk) is attached to the carriage 202. Plural nozzles are included in the inkjet head 203 and arranged in a direction perpendicular to the main scanning direction so as to downwardly discharge the ink. The ink cartridges 204 for supplying various colored ink to the inkjet head 203 are attached to the carriage 202 so that the ink cartridges 204 are replaceable.

An air vent (not illustrated) communicating with the air is formed on an upper side if the ink cartridge 204, and a supply port for supplying the ink to the inkjet head 203 is downwardly formed. A porous body (not illustrated) filled with the ink is installed inside the ink cartridge. At this time, capillary force caused by the porous body maintains the ink supplied to the inkjet head 203 to have slightly negative pressure.

Instead of arranging the inkjet heads discharging the colored ink, one inkjet head for discharging various colored ink may be provided.

The carriage 202 is supported by the main guide rod 209 on a downstream side relative to a carrying direction of the paper P so as to be freely slidable along the main guide rod 209, and an upstream side relative to the carrying direction of the paper P is supported by the sub guide rod 210 so as to be freely slidable along the sub guide rod 210. A timing belt 214 bridges to connects a driving pulley 212 rotated by a main scanning motor 211 and a driven pulley 213. The timing belt is partly fixed to the carriage 202. By rotating the main scanning motor 211, the carriage 202 can be moved in the main scanning direction.

On the other hand, in order to carry the paper P stacked on the paper feed cassette 206 below the inkjet head 203, there are provided a paper feed roller 215 for separating and carrying the paper P from the paper feed cassette 206, a friction pad 216, a guide member 217 for guiding the paper P, a carrying roller 218 for inverting the paper P and carry the paper, a carrying wheel 219 pressed on a peripheral surface of the carrying roller 218, and a top end wheel 220 determining an angle of sending the paper P from the carrying roller 218. The carrying roller 218 is rotated by the sub scanning motor 221 via a gear array (not illustrated).

Further, a guide member 222 is provided to guide the paper P sent by the carrying roller 218 below the inkjet head 203 within a movement range of the carriage 202 in the main scanning direction. On the downstream side of the carrying direction of the paper P relative to the guide member 222, there are provided a carrying wheel 223 and a spur 224 which are rotated to eject the paper P. Further, there are provided guide members 225 and 226 for guiding the paper P sent by the carrying wheel 223 and the spur 224, a copy ejecting roller 227 for sending the paper P guided by the guide members 225 and 226 to the copy receiving tray 208 and a spur 228.

When an image is recorded on the paper P, the inkjet head 203 is moved while moving the carriage 202 in response to an image signal. For example, after discharging an ink onto a stopping paper P to record one line, the paper P is carried by the one line, and recording and carrying are repeated. When a signal indicating that the image is completely recorded or a signal indicating that the back end of the paper P reaches a recording area are received, an operation of recording the image is completed and the paper P is ejected.

At a position outside the recording area on the right side of the moving direction of the carriage 202, a recovery device 229 for recovering from discharge failure of the inkjet head 203 is provided. The recovery device 229 includes a cap unit (not illustrated), a suction unit (not illustrated) and a cleaning unit (not illustrated). While the carriage 202 waits for the recording, the carriage 202 is moved on the side of the recovery device 229 so that the inkjet head 203 is capped by a capping unit to maintain the nozzle in a wet state. Thus, the discharge failure caused by drying of the ink can be prevented. Further, degrees of viscosity of the ink from the nozzles are made constant to maintain stable discharging capability by discharging the ink which is not related to recording of the image while the image is recorded.

When the discharge failure occurs, the nozzle of the inkjet head 203 causing the discharge failure is sealed by the capping unit, the ink and air bubbles are sucked by the suction unit via a tube, and the ink, dust and so on (adhered to the nozzle) are removed to thereby recover from the discharge failure. At this time, the ink sucked by the suction unit is ejected to a waste ink reservoir provided below the main body 201 and sucked and retained by an ink absorber.

Embodiments

[Synthesis of a PZT Precursor Solution]

After dissolving lead acetate trihydrate in methoxyethanol, the solution is dehydrated to thereby obtain a methoxyethanol solution of lead acetate trihydrate. Meanwhile, after dissolving titanium isopropoxide and zirconium isopropoxide in methoxyethanol, the solution undergoes an alcoholysis reaction and an esterification reaction. Next, the methoxyethanol solution of lead acetate trihydrate is added to it to thereby obtain a PZT precursor solution of 0.5 mol/L. In order to avoid degradation of crystallographic quality due to so-called "lead extraction" during heat processing, lead of 10 mol % is excessively added relative to the stoichiometric composition.

EXAMPLE 1

A thermally-oxidized film (the vibrating plate 112*a*) having a thickness of 1 μm is formed on a silicon wafer. A laminated body of a titanium film having a thickness of 50 nm, a platinum film having a thickness of 200 nm and a $SrRuO_3$ film having a thickness of 100 nm are formed on the thermally-oxidized film by sputtering.

The PZT precursor solution is coated on the laminated body by a spin coat method, dried at 120° C. and thermally decomposed at 500° C. This process is repeated three times. Thereafter, the processed laminated body is crystallized by a rapid thermal processing (RTA) at 700° C. The above processes are repeated four times to thereby form a $Pb(Zr_{0.53}Ti_{047})O_3$ film having a film thickness of 1 μm.

Next, a laminated body of a $SrRuO_3$ film having a thickness of 100 nm and a platinum film having a thickness of 100 nm is formed on the $Pb(Zr_{0.53}Ti_{0.47})O_3$ film.

Next, a photo resist TSMR8800 manufactured by Tokyo Ohka Kogyo Co., Ltd. is coated on the above laminated body by a spin coating method. Then, a resist pattern is formed by photolithography and patterned using an inductively-coupled plasma (ICP) etching device manufactured by SAMCO Inc. to thereby form the piezoelectric element 120 as illustrated in FIG. 1.

Next, an $Al_2O_3$ film (the insulating film 131) having a thickness of 50 nm is formed by an ALD method on the vibrating plate 112*a* on which the piezoelectric element 120 is formed. At this time, raw materials of Al and O are TMA manufactured by Sigma-Aldrich Co. LLC and $O_3$ generated by an ozone generator. Ai and O are alternately laminated to form the $Al_2O_3$ film.

Next, a $ZrO_2$ film (the insulating film 132) having a thickness of 50 nm is formed by an ALD method on the insulating film 131. At this time, raw materials of Zr and O are $Zr(OC(CH_3)_3)_4$ manufactured by Sigma-Aldrich Co. LLC and $O_3$ generated by an ozone generator. Zr and O are alternately laminated to form the $ZrO_2$ film.

Next, after forming an $SiO_2$ film having a thickness of 500 nm on the insulating film 132 using a plasma CVD method, a contact hole is formed by etching to thereby form the insulating film 133.

Next after forming an Al film using sputtering, the wirings 140 and 150 are formed by patterning using etching.

Next, after forming an $Si_3N_4$ film having a thickness of 1 μm on the wirings 140 and 150 using a plasma CVD method, a contact hole is formed by etching to thereby form the insulating film 134.

Next, portions of the insulating films 134 and 133 over the space separated by the partition walls 112*b* except for portions corresponding to the wiring 140 are continuously etched. As a result, the film thickness of the portion without the insulating film 133 is 37 nm. Further, the contact holes 134*a* and 134*b* are formed by etching.

Next, after forming the partitions 112*b* by etching the silicon wafer, it is connected to the nozzle substrate 111 having the nozzle 111*a* to thereby obtain the inkjet head 100.

EXAMPLE 2

Except for the film thicknesses of 20 nm of the $Al_2O_3$ film (the insulating film 131) and the $ZrO_2$ film (the insulating film 132), the inkjet head 100 is obtained in a similar manner to the Example 1. As a result, the film thickness of the portion without the insulating film 133 is 9 nm.

EXAMPLE 3

Except for the film thicknesses of 100 nm of the $Al_2O_3$ film (the insulating film 131) and the $ZrO_2$ film (the insulating film 132), the inkjet head 100 is obtained in a similar manner to the Example 1. As a result, the film thickness of the portion without the insulating film 133 is 25 nm.

COMPARATIVE EXAMPLE 1

Except that the $ZrO_2$ film (the insulating film 132) is not formed, an inkjet head is obtained in a similar manner to the Example 1.

[Electric Property]

Electric properties of the inkjet heads of Examples 1 to 3 and Comparative Example 1 are evaluated. Then, after the inkjet head is left uncontrolled under circumstances of 80° C. and 85% RH, an electric property is evaluated.

A saturation polarization Ps [° C./$cm^2$] under electric field intensity of 150 kV/cm is measured as an electric property.

[Discharge Property]

A voltage of −10 to −30 V in a simple Push waveform is applied between the common electrode 121 and an individual electrode 123 of the inkjet heads of the Examples 1 to 3 and the Comparative Example 1 to thereby evaluate discharging of ink having viscosity of 5 cp. The evaluation is as follows. A case where the ink can be discharged is marked by o, and a case where the ink cannot be discharged is marked by x.

The evaluation results of the electric property and the discharge property are indicated in Table 1.

TABLE 1

| | ELECTRIC PROPERTY Ps [μC/$cm^2$] | | |
|---|---|---|---|
| | INITIAL STAGE | AFTER LEAVING FOR PREDETERMINED TIME | DISCHARGE PROPERTY |
| EXAMPLE 1 | 47 | 47 | ○ |
| EXAMPLE 2 | 48 | 48 | ○ |
| EXAMPLE 3 | 46 | 45 | ○ |
| COMPARATIVE EXAMPLE 1 | 47 | 26 | ○ |

Referring to Table 1, the inkjet head of the Examples 1 to 3 are excellent in the discharge property and can suppress degradation of the piezoelectric substance caused by moisture in the air.

On the other hand, the piezoelectric substance of the inkjet head of the Comparative Example is degraded by moisture in the air. This degradation in the Comparative Example is supposed to be caused because the $ZrO_2$ film (the insulating film 132) is not formed and therefore the $Al_2O_3$ film (the insulating film 131) is etched in continuously etching the insulating films 134 and 135.

Accordingly, embodiments of the present invention provide a novel and useful inkjet head and an inkjet plotter solving one or more of the problems discussed above. More specifically, the embodiments of the present invention may provide an inkjet head and an inkjet plotter including the inkjet head with which the piezoelectric substance can be prevented from degrading with the moisture in the air and being highly densely packed and simultaneously downsized.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiment of the present invention has been described in detail, it should be understood that various changes, substitutions, and alterations could be made thereto without departing from the spirit and scope of the invention.

This patent application is based on Japanese Priority Patent Application No. 2011-049677 filed on Mar. 7, 2011, the entire contents of which are hereby incorporated herein by reference.

What is claimed is:

1. An inkjet head comprising:

a nozzle substrate having a nozzle;

a vibrating plate formed above the nozzle substrate;

a liquid chamber formed by a space between the vibrating plate and the nozzle substrate and separated by partitions;

a piezoelectric element formed by sequentially laminating a common electrode, a piezoelectric substance and an individual electrode over the space, the common electrode extending above the partition;

a first insulating film having a first opening;

a second insulating film formed on the first insulating film and having a second opening;

a first wiring connected to the individual electrode and pulled through the first opening and the second opening over the common electrode;

a third insulating film formed on the second insulating film and having a third opening; and a fourth insulating film formed on the first wiring and having a fourth opening, wherein the first wiring passes through the third opening and is formed on the third insulating film, wherein the first wiring is exposed from the fourth opening so as to be externally connected, wherein the third insulating film and the fourth insulating film are not formed over at least a portion of the second insulating film that is disposed above the liquid chamber.

2. The inkjet head according to claim 1, wherein the third insulating film and the fourth insulating film are formed by etching, and the second insulating film is a mask layer used in the etching.

3. The inkjet head according to claim 1, wherein the second insulating film is formed by an ALD method.

4. The inkjet head according to claim 1, wherein a first thickness of the second insulating film on a region where the third insulating film is not formed is smaller than a second thickness of the second insulating film immediately beneath the third insulating layer.

5. The inkjet head according to claim 1, wherein the second thickness of the second insulating film is 5 nm or greater and 40 nm or smaller.

6. The inkjet head according to claim 1, wherein a thickness of the first insulating layer is 20 nm to 100 nm.

7. The inkjet head according to claim 1, wherein the first insulating film is formed by an ALD method.

8. An inkjet plotter including an nkjet head, the inkjet head comprising:

a nozzle substrate having a nozzle;

a vibrating plate formed above the nozzle substrate;

a liquid chamber formed by a space between the vibrating plate and the nozzle substrate and separated by partitions;

a piezoelectric clement formed by sequentially laminating a common electrode, a piezoelectric substance and an individual electrode over the space, the common electrode extending above the partition;

a first insulating film having a first opening;

a second insulating film formed on the first insulating film and having a second opening;

a first wiring connected to the individual electrode and pulled through the first opening and the second opening over the common electrode;

a third insulating film formed on the second insulating film and having a third opening; and a fourth insulating film formed on the first wiring and having a fourth opening, wherein the first wiring passes through the third opening and is formed on the third insulating film, wherein the first wiring is exposed from the fourth opening so as to be externally connected, wherein the third insulating film and the fourth insulating film are not formed over at least a portion of the second insulating film disposed above the liquid chamber.

9. The inkjet plotter according to claim 8, wherein the third insulating film and the fourth insulating film are formed by etching, and the second insulating film is a mask layer used in the etching.

10. The inkjet plotter according to claim 8, wherein the second insulating film is formed by an ALD method.

11. The inkjet plotter according to claim 8, wherein a first thickness of the second insulating film on a region where the third insulating film is not formed is smaller than a second thickness of the second insulating film immediately beneath the third insulating layer.

12. The inkjet plotter according to claim 8, wherein the second thickness of the second insulating film is 5 nm or greater and 40 nm or smaller.

13. The inkjet plotter according to claim 8, wherein a thickness of the first insulating layer is 20 nm to 100 nm.

14. The inkjet plotter according to claim 8, wherein the first insulating film is formed by an ALD method.

15. The inkjet head according to claim 1, wherein the first insulating film has an additional first opening formed therein, the second insulating film has an additional second opening formed therein, the third insulating film has an additional third opening formed therein, the fourth insulating film has an additional fourth opening formed therein, the inkjet head further comprises a second wiring connected to the common electrode and pulled through the additional first opening, the additional second opening and the additional third opening, and the second wiring is exposed from the additional fourth opening so as to be externally connected.

16. An inkjet head comprising:

a nozzle substrate having a nozzle;

a vibrating plate formed above the nozzle substrate;

a liquid chamber formed by a space between the vibrating plate and the nozzle substrate and separated by partitions;

a piezoelectric element disposed over the space, the piezoelectric element including a common electrode, a piezoelectric substance disposed over the common electrode, and an individual electrode disposed over the piezoelectric substance and the common electrode;

a first insulating film having a first opening and an additional first opening;

a second insulating film formed on the first insulating film and having a second opening and an additional second opening;

a third insulating film formed on the second insulating film and having a third opening and an additional third opening;

a first wiring connected to the individual electrode and pulled through the first opening, the second opening and the third opening and is formed on the third insulating film and the common electrode;

a fourth insulating film formed on the first wiring and having a fourth opening and an additional fourth opening; and a second wiring connected to the common electrode and pulled through the additional first opening, the additional second opening and the additional third opening, wherein the first wiring connected to the individual electrode is exposed from the fourth opening so as to be externally connected, and the second wiring connected to the common electrode is exposed from the additional fourth opening so as to be externally connected.

* * * * *